US007108340B2

(12) United States Patent
Lai

(10) Patent No.: US 7,108,340 B2
(45) Date of Patent: Sep. 19, 2006

(54) RAIL ASSEMBLY FOR A DRAWER

(75) Inventor: Yung-Tsai Lai, Taichung (TW)

(73) Assignee: Hsing Lyiang Industry Co., Ltd., Taichung (TW)

( * ) Notice: Subject to any disclaimer, the term of this patent is extended or adjusted under 35 U.S.C. 154(b) by 260 days.

(21) Appl. No.: 10/864,122

(22) Filed: Jun. 8, 2004

(65) Prior Publication Data

US 2005/0269922 A1 Dec. 8, 2005

(51) Int. Cl.
*A47B 88/00* (2006.01)

(52) U.S. Cl. ..... 312/334.46; 312/333

(58) Field of Classification Search ..... 312/334.44, 312/334.46, 334.47, 333, 334.1, 334.7, 334.8, 312/334.9, 334.11; 384/21, 22
See application file for complete search history.

(56) References Cited

U.S. PATENT DOCUMENTS 1,537,067 A * 5/1925 Card ..... 384/19
4,473,262 A * 9/1984 Staye ..... 312/333
5,255,983 A * 10/1993 Parvin ..... 384/21
5,433,517 A * 7/1995 Fleisch ..... 312/334.8
5,551,775 A * 9/1996 Parvin ..... 312/334.11
5,757,109 A * 5/1998 Parvin ..... 312/334.11
6,390,574 B1 * 5/2002 Fraccaro ..... 312/333
6,682,158 B1 * 1/2004 Lai ..... 312/333
6,729,703 B1 * 5/2004 Le ..... 312/333
6,824,233 B1 * 11/2004 Chen et al. ..... 312/334.46

* cited by examiner

*Primary Examiner*—Janet M. Wilkens
(74) *Attorney, Agent, or Firm*—Christensen O'Connor Johnson Kindness PLLC

(57) ABSTRACT

A rail assembly includes a first rail formed with a stopping protrusion, and a second rail mounted slidably on the first rail and formed with an engaging protrusion. The engaging protrusion includes a head body that has opposite top and bottom ends and that gradually reduces in cross-section from the top end to the bottom end. The bottom end of the head body is formed with a curved nose that protrudes downwardly therefrom and that is blocked by the stopping protrusion when the second rail is moved frontwardly to a front position relative to the first rail. The head body is elastically deformable so as to be compressed by the stopping protrusion to an extent that the nose is able to slide over the stopping protrusion when the second rail is further moved frontwardly from the front position by a pulling force.

5 Claims, 8 Drawing Sheets

RAIL ASSEMBLY FOR A DRAWER

BACKGROUND OF THE INVENTION

1. Field of the Invention

This invention relates to a rail assembly for a drawer, more particularly to a rail assembly with an engaging protrusion that is elastically deformable.

2. Description of the Related Art

FIGS. 1 to 3 illustrates a conventional rail assembly 1 for mounting a drawer 3 in a cabinet 2. The rail assembly 1 includes a first rail 11 that has a stopping protrusion 13 protruding therefrom, and a second rail 12 that is mounted slidably on the first rail 11 and that is formed with an engaging protrusion 14 which is blocked by the stopping protrusion 13 when the second rail 12 is moved to a front position relative to the first rail 11 where the drawer 3 is fully opened so as to arrest further frontward movement of the second rail 12 relative to the first rail 11. The engaging protrusion 14 includes a lever 14' that has a fixed end 140 fixed to the second rail 12, and a distal free end 141 opposite to the fixed end 140, and that defines a shoulder 142 between the fixed end 140 and the distal free end 141. The shoulder 142 engages the stopping protrusion 13 when the second rail 12 is moved to the front position, and is disengaged from the stopping protrusion 13 when the distal free end 141 of the lever 14 is forced upwardly, thereby permitting further frontward movement of the second rail 12.

The conventional rail assembly 1 is disadvantageous in that forcing of the lever 14 for the purpose of detaching the drawer 3 from the cabinet 2 requires the user to use one of his or her hands to lift the lever 14 (see FIG. 3) while the other hand holds and pulls the drawer 3 out of the cabinet 2, which is relatively inconvenient to conduct, particularly when the drawer 3 is heavy.

SUMMARY OF THE INVENTION

The object of the present invention is to provide a rail assembly that is capable of overcoming the aforesaid drawback associated with the prior art.

According to this invention, a rail assembly for a drawer comprises: a first rail defining a track, having an inner surface and a front end, and formed with a stopping protrusion that is disposed adjacent to the front end, that protrudes from the inner surface into the track, and that has a rear end; and a second rail mounted slidably on the first rail, slidable along the track, having a rear end, and formed with an engaging protrusion that is disposed adjacent to the rear end of the second rail and that protrudes therefrom toward the inner surface of the first rail. The engaging protrusion includes a head body that has opposite top and bottom ends and that gradually reduces in cross-section from the top end to the bottom end. The bottom end of the head body is formed with a curved nose that protrudes downwardly therefrom and that is blocked by the rear end of the stopping protrusion when the second rail is moved frontwardly to a front position relative to the first rail. The head body is elastically deformable so as to be compressed by the rear end of the stopping protrusion to an extent that the nose is able to slide over the rear end of the stopping protrusion when the second rail is further moved frontwardly from the front position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
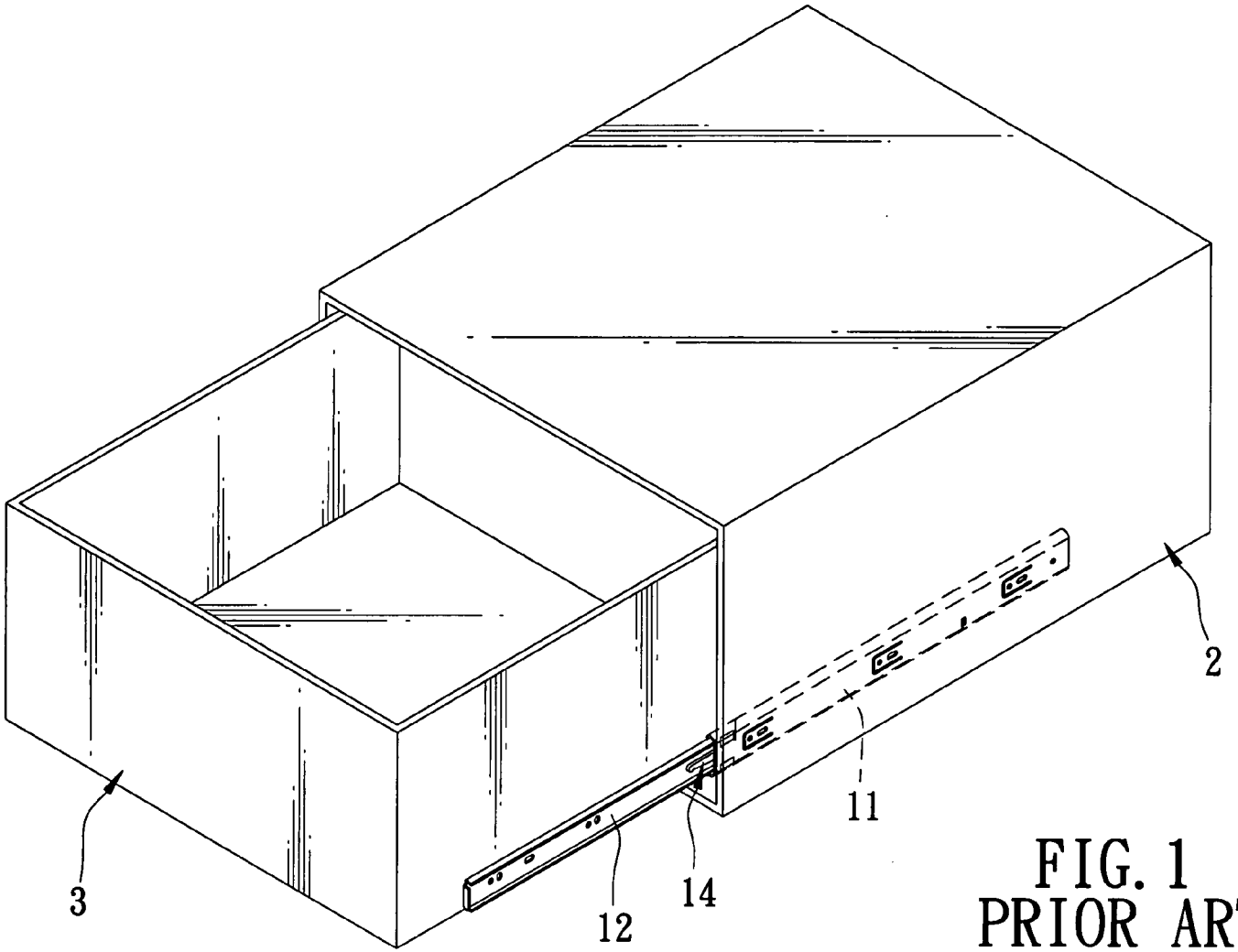
FIG. 1 PRIOR ART
FIG. 1 is a perspective view of a conventional rail assembly for mounting slidably a drawer in a cabinet.
Figure 2:
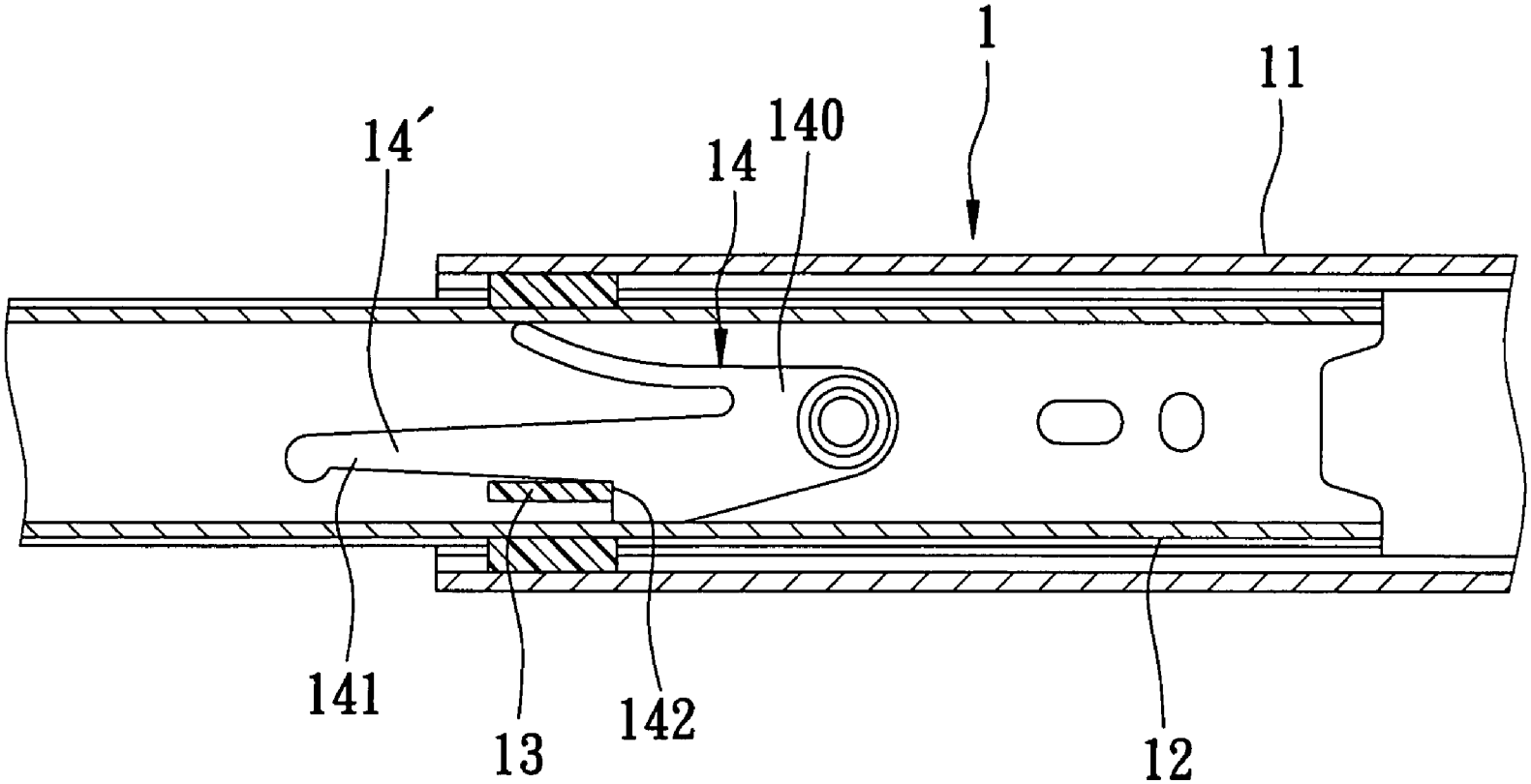
FIG. 2 PRIOR ART
FIG. 2 is a fragmentary sectional view to illustrate how an engaging protrusion is stopped by a stopping protrusion.
Figure 3:
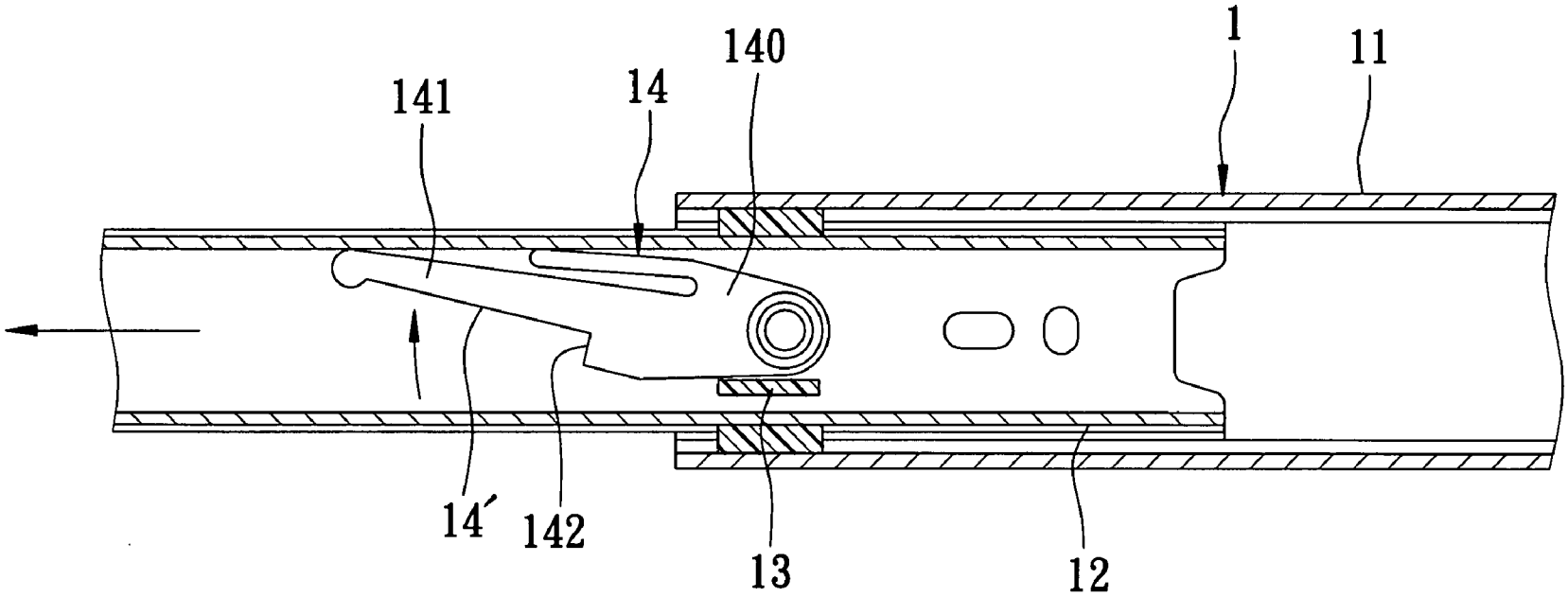
FIG. 3 PRIOR ART
FIG. 3 is a fragmentary sectional view to illustrate how the engaging protrusion is slid over the stopping protrusion.
Figure 4:
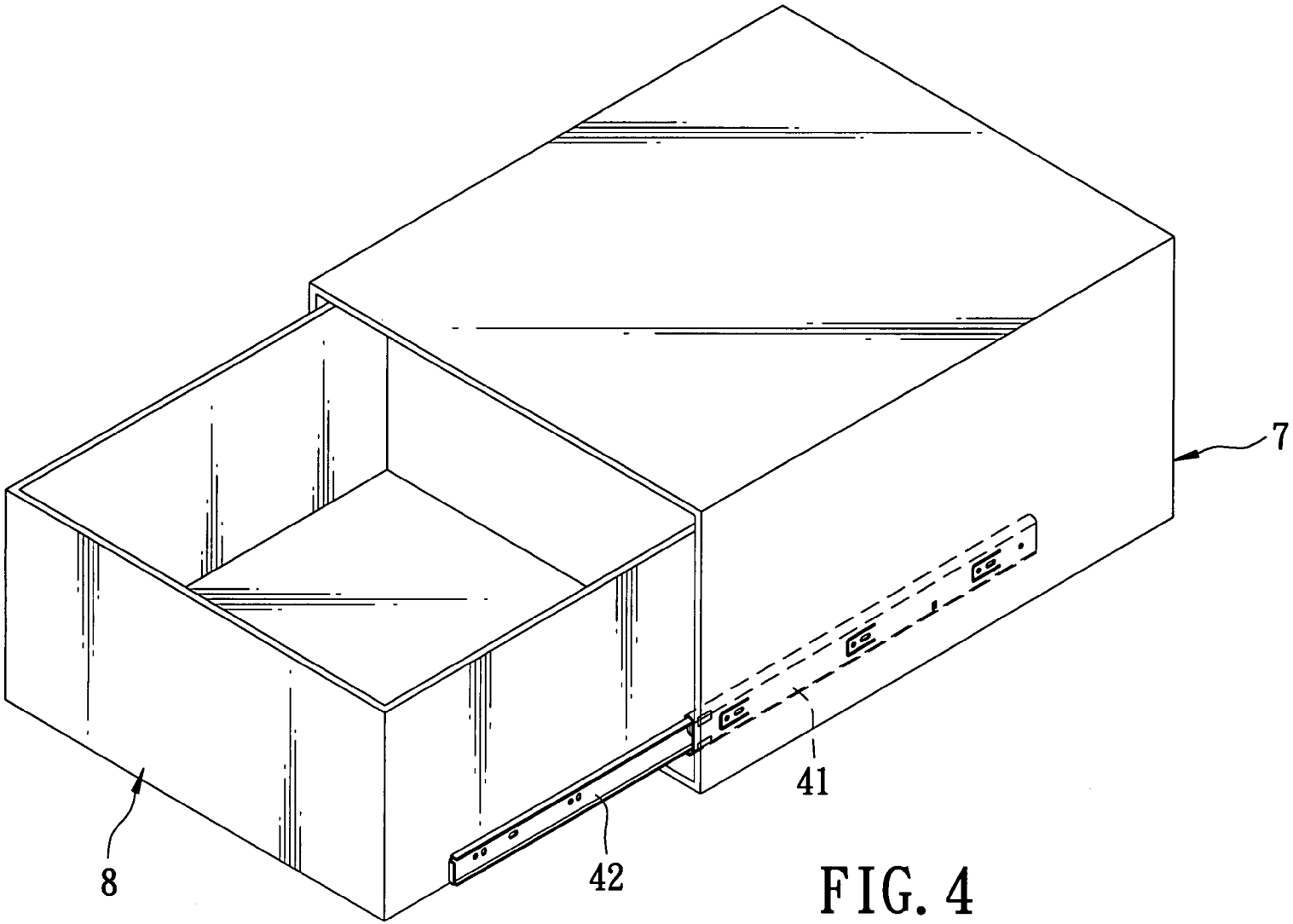
FIG. 4 is a perspective view of the preferred embodiment of a rail assembly according to this invention in a state of use.
Figure 5:
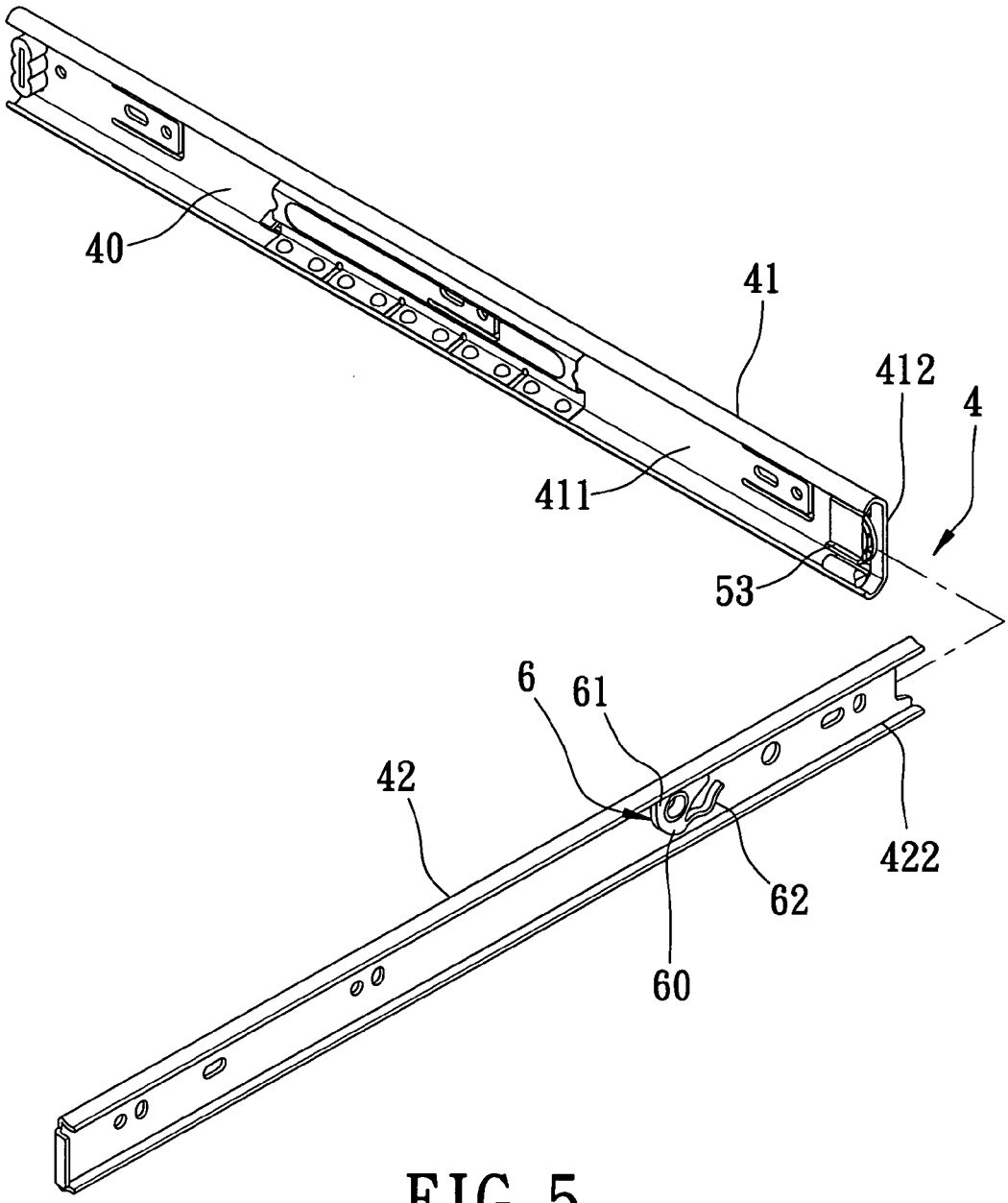
FIG. 5 is an exploded perspective view of the preferred embodiment.
Figure 6:
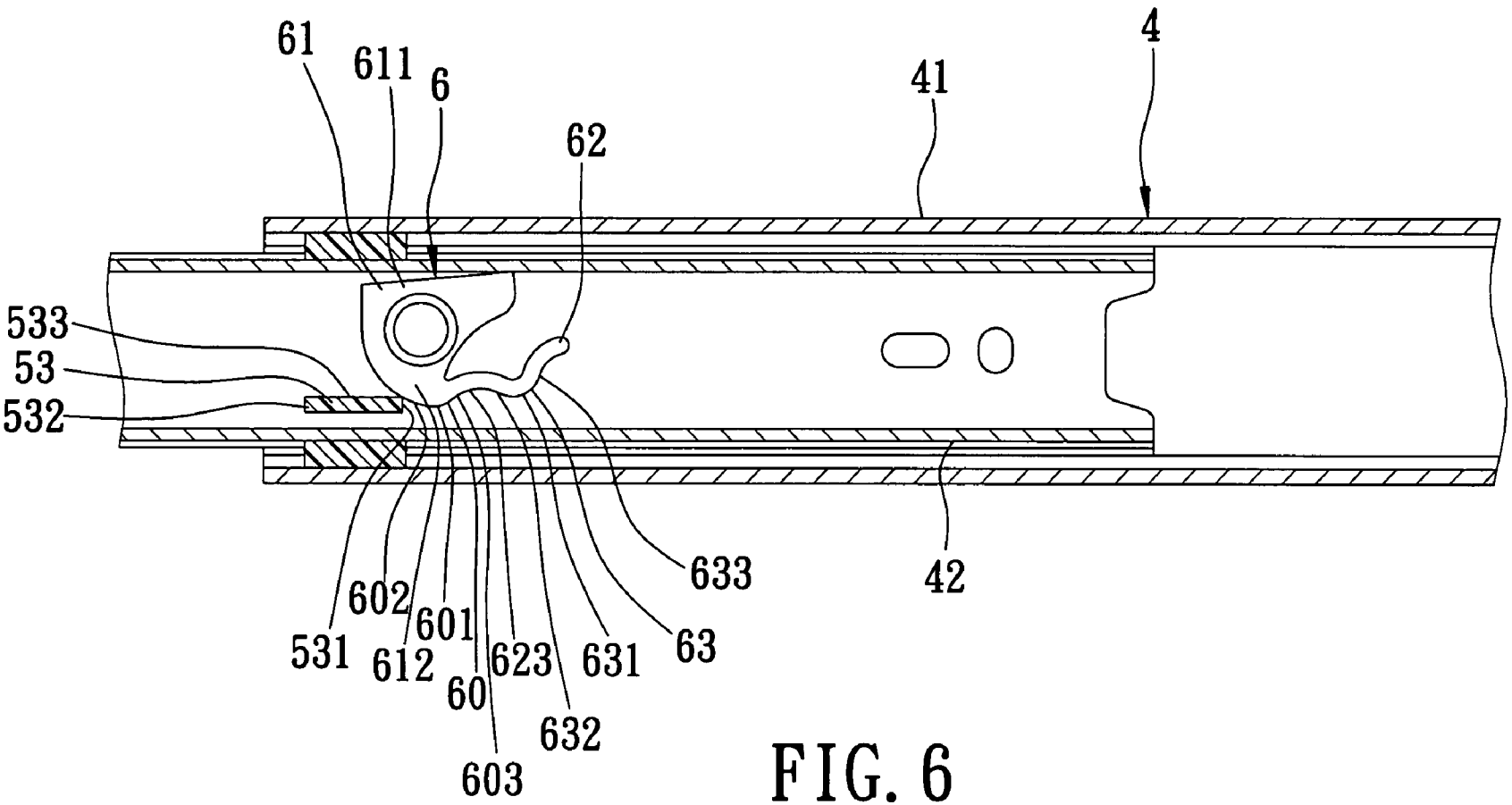
FIG. 6 is a fragmentary sectional view to illustrate how a nose of an engaging protrusion is blocked by a stopping protrusion of the preferred embodiment.
Figure 7:
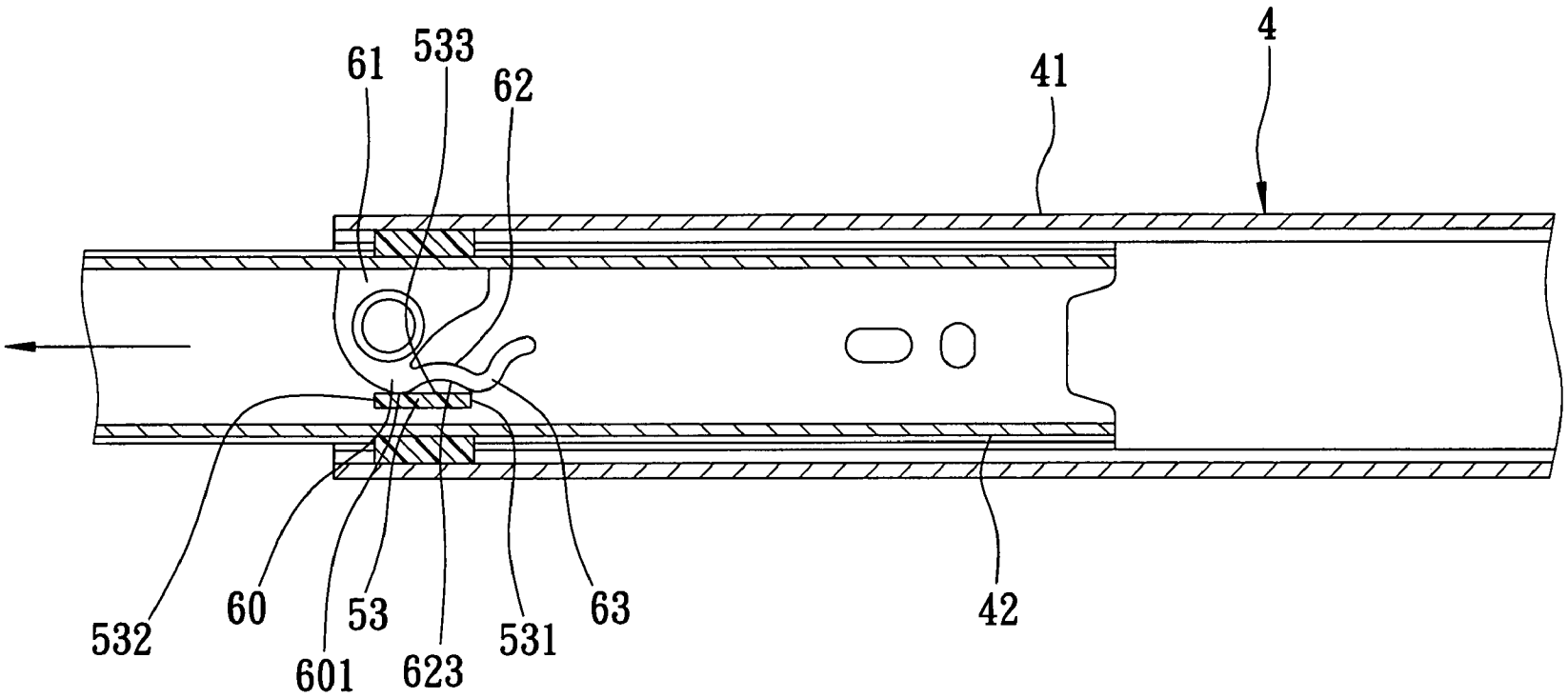
FIG. 7 is fragmentary sectional view to illustrate how the nose is slid over the stopping protrusion and how a second nose of the engaging protrusion is blocked by the stopping protrusion of the preferred embodiment.
Figure 8:
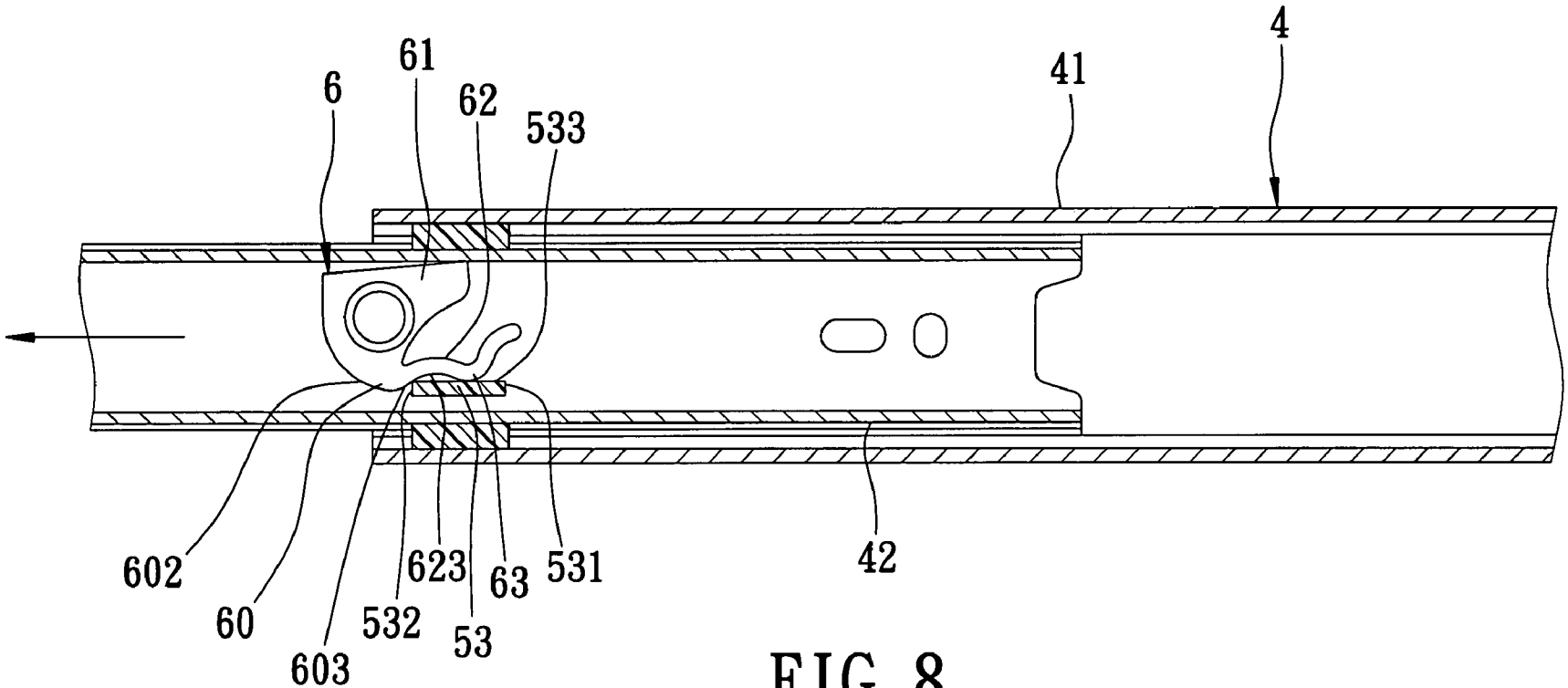
FIG. 8 is a fragmentary sectional view to illustrate how the second nose of the engaging protrusion is slid over the stopping protrusion of the preferred embodiment.

FIGS. 4 to 8 illustrate the preferred embodiment of a rail assembly 4 according to the present invention for mounting slidably a drawer 8 in a cabinet 7.

The rail assembly 4 includes: a first rail 41 defining a track 40, having an inner surface 411 and a front end 412, and formed with a stopping protrusion 53 that is disposed adjacent to the front end 412, that protrudes from the inner surface 411 into the track 40, and that has a rear end 531; and a second rail 42 mounted slidably on the first rail 41, slidable along the track 40, having a rear end 422, and formed with an engaging protrusion 6 that is disposed adjacent to the rear end 422 of the second rail 42 and that protrudes therefrom toward the inner surface 4111 of the first rail 41. The engaging protrusion 6 includes a head body 61 that has opposite top and bottom ends 611, 612 and that gradually reduces in cross-section from the top end 611 to the bottom end 612. The bottom end 612 of the head body 61 is formed with a curved first nose 60 that protrudes downwardly therefrom and that is blocked by the rear end 531 of the stopping protrusion 53 when the second rail 42 is moved frontwardly to a first front position (see FIG. 6) relative to the first rail 41. The head body 61 is elastically deformable so as to be compressed by the rear end 531 of the stopping protrusion 53 to an extent that the first nose 60 is able to slide over the rear end 531 of the stopping protrusion 53 (see FIG. 7) when the second rail 42 is further moved frontwardly from the first front position by a pulling force that is sufficient to compress the head body 61 to the required extent.

In this embodiment, the head body 61 is integrally formed with the first nose 60, and is elastically deformable so as to be compressed together with the first nose 60 when the first nose 60 is pressed by the rear end 531 of the stopping protrusion 53 upon frontward movement of the second rail 42 from the first front position.

The stopping protrusion 53 further has a front end 532 opposite to the rear end 531 of the stopping protrusion 53, and an upper surface 533 extending between the front and rear ends 532, 531 of the stopping protrusion 53. The first nose 60 defines a lowest point 601, and has a curved front guiding face 602 that extends upwardly and frontwardly from the lowest point 601, and a curved rear guiding face 603 that extends upwardly and rearwardly from the lowest point 601. The lowest point 601 of the first nose 60 is in sliding contact with the upper surface 533 of the stopping protrusion 53 when the second rail 42 is disposed at a middle front position (see FIG. 7) frontward of the first front position. The front guiding face 602 of the first nose 60 is in sliding contact with the rear end 531 of the stopping protrusion 53 when the second rail 42 is moved frontwardly from the first front position to the middle front position. The rear guiding face 603 of the first nose 60 is in sliding contact with the front end 532 of the stopping protrusion 53 when the second rail 42 is moved rearwardly from a second front position (see FIG. 8), where the first nose 60 is disposed frontwardly of the front end 532 of the stopping protrusion 53, to the middle front position.

The engaging protrusion 6 further includes a tail 62 that extends rearwardly from the first nose 60 and that has a curved second nose 63 protruding downwardly therefrom. The second nose 63 is blocked by the rear end 531 of the stopping protrusion 53 when the second rail 42 is disposed at the middle front position (see FIG. 7) so as to provide a second blocking function to arrest undesired removal of the drawer 8 from the cabinet 7. The tail 62 is elastically flexible so as to flex toward the head body 61 to an extent that the second nose 63 is able to slide over the rear end 531 of the stopping protrusion 53 when the second rail 42 is moved frontwardly from the middle front position to the second front position by the pulling force. The first and second noses 60, 63 cooperatively define a curved recess 623 therebetween. The second nose 63 has a lowest point 631, a curved front guiding face 632 extending upwardly and frontwardly from the lowest point 631 of the second nose 63, and a curved rear guiding face 633 extending upwardly and rearwardly from the lowest point 631 of the second nose 63 so as to permit sliding movement of the second nose 63 on the stopping protrusion 53.

The engaging protrusion 6 is preferably made from a steel filled epoxy material, such as Devcon Plastic Steel, which is a trade name of Taylor and Art Plastics, Inc.

With the inclusion of the first nose 60 of the engaging protrusion 6 in the rail assembly 4 of this invention, the aforesaid drawback associated with the prior art can be eliminated. Moreover, due to the second nose 63 of the tail 62 of the engaging protrusion 6, undesired removal of the drawer 8 from the cabinet 7 can be avoided.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A rail assembly for a drawer, comprising:

a first rail defining a track, having an inner surface and a front end, and formed with a stopping protrusion that is disposed adjacent to said front end, that protrudes from said inner surface into said track, and that has a rear end; and a second rail mounted slidably on said first rail, slidable along said track, having a rear end, and formed with an engaging protrusion that is disposed adjacent to said rear end of said second rail and that protrudes therefrom toward said inner surface of said first rail;

wherein said engaging protrusion includes a head body that has opposite top and bottom ends and that gradually reduces in cross-section from said top end to said bottom end, said bottom end of said head body being formed with a curved first nose that protrudes downwardly therefrom and that is blocked by said rear end of said stopping protrusion when said second rail is moved frontwardly to a first front position relative to said first rail; and wherein said head body is elastically deformable so as to be compressed by said rear end of said stopping protrusion to an extent that said first nose is able to slide over said rear end of said stopping protrusion when said second rail is further moved frontwardly from said first front position.

2. The rail assembly of claim 1, wherein said head body is elastically deformable so as to be compressed together with said first nose when said first nose is pressed by said rear end of said stopping protrusion upon frontward movement of said second rail from said first front position.

3. The rail assembly of claim 2, wherein said stopping protrusion further has a front end opposite to said rear end of said stopping protrusion, and an upper surface extending between said front and rear ends of said stopping protrusion, said first nose defining a lowest point and having a curved front guiding face that extends upwardly and fromwardly from said lowest point, and a curved rear guiding face that extends upwardly and rearwardly from said lowest point, said lowest point of said first nose being in sliding contact with said upper surface of said stopping protrusion when said second rail is disposed at a middle front position frontward of said first front position, said front guiding face of said first nose being in sliding contact with said rear end of said stopping protrusion when said second rail is moved frontwardly from said first front position to said middle front position, said rear guiding face of said first nose being in sliding contact with said front end of said stopping protrusion when said second rail is moved rearwardly from a second front position, where said first nose is disposed frontwardly of said front end of said stopping protrusion, to said middle front position.

4. The rail assembly of claim 3, wherein said engaging protrusion further includes a tail that extends rearwardly from said first nose and that has a curved second nose protruding downwardly therefrom, said second nose being blocked by said rear end of said stopping protrusion when said second rail is disposed at said middle front position, said tail being elastically flexible so as to flex toward said head body to an extent that said second nose is able to slide over said rear end of said stopping protrusion when said second rail is moved frontwardly from said middle front position to said second front position.

5. The rail assembly of claim 4, wherein said engaging protrusion is made from a steel filled epoxy material.

* * * * *